313-414 SR
8/23/83 OR 4,400,649

United States Patent [19]
Chen

[11] 4,400,649
[45] Aug. 23, 1983

[54] COLOR PICTURE TUBE HAVING AN IMPROVED EXPANDED FOCUS LENS TYPE INLINE ELECTRON GUN

[75] Inventor: Hsing-Yao Chen, Landisville, Pa.

[73] Assignee: RCA Corporation, New York, N.Y.

[21] Appl. No.: 282,231

[22] Filed: Jul. 10, 1981

[51] Int. Cl.³ ..... H01J 29/50; H01J 29/62
[52] U.S. Cl. ..... 313/414; 313/449; 313/460
[58] Field of Search ..... 313/414, 449, 460, 458, 313/412, 409

[56] References Cited

U.S. PATENT DOCUMENTS

| | | | |
|---|---|---|---|
| 125,648 | 8/1872 | Hughes | 238/150 |
| 201,692 | 3/1878 | Hughes et al. | 241/69 |
| 3,873,879 | 3/1975 | Hughes | 315/13 C |
| 4,275,332 | 6/1981 | Ashizaki et al. | 313/409 X |
| 4,317,065 | 2/1982 | Hughes | 313/414 |
| 4,370,592 | 1/1983 | Hughes et al. | 313/414 |

*Primary Examiner*—Palmer C. Demeo
*Attorney, Agent, or Firm*—Eugene M. Whitacre; Dennis H. Irlbeck

[57] ABSTRACT

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members each having three separate inline apertures therein. Each electrode also includes a peripheral rim. The peripheral rims of the two electrodes face each other. The apertured portion of each electrode is within a recess set back from the rim. The width of the recess in at least one of the electrodes is wider at the center beam path than at the side beam paths, measured perpendicular to the plane containing the electron beam paths.

3 Claims, 5 Drawing Figures

Fig. 1
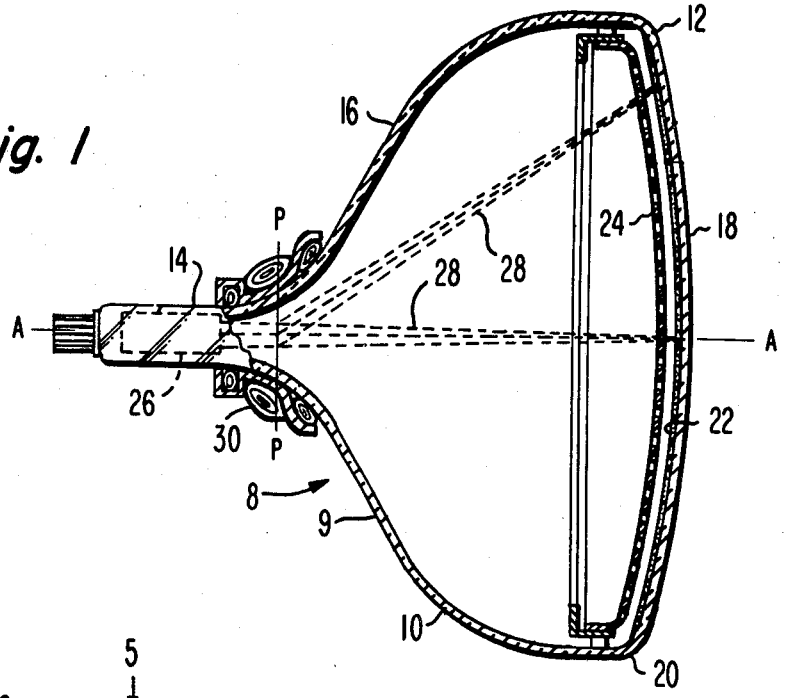
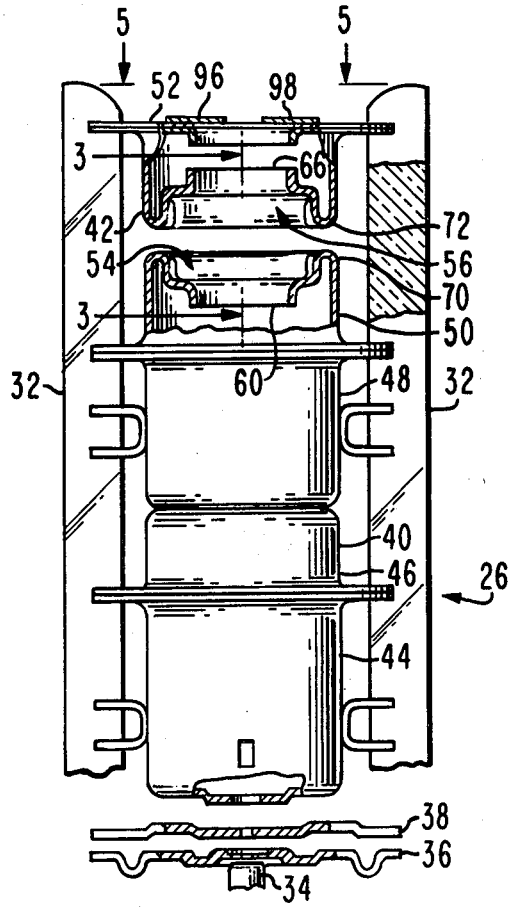
Fig. 2

COLOR PICTURE TUBE HAVING AN IMPROVED EXPANDED FOCUS LENS TYPE INLINE ELECTRON GUN

BACKGROUND OF THE INVENTION

The present invention relates to color picture tubes having improved inline electron guns, and particularly to such guns having an improved expanded focus lens for reduced spherical aberration.

An inline electron gun is one designed to generate or initiate preferably three electron beams in a common plane and direct those beams along convergent paths in that plane to a point or small area of convergence near the tube screen. In one type of inline electron gun shown in U.S. Pat. No. 3,873,879, issued to R. H. Hughes on Mar. 25, 1975, the main electrostatic focusing lenses for focusing the electron beams are formed between two electrodes referred to as the first and second accelerating and focusing electrodes. These electrodes include two cup-shaped members having bottoms facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced from each other, thereby providing a severe limitation on focus lens design. It is known in the art that the larger the focus lens diameter, the less will be the spherical aberration which restricts the high current focus quality.

In addition to the focus lens diameter, the spacing between focus lens electrode surfaces is important, because greater spacing provides a more gentle voltage gradient in the lens which also reduces spherical aberration. Unfortunately, greater spacing between electrodes beyond a particular limit (typically 1.27 mm) generally is not permissible because of beam bending from electrostatic charges on the neck glass penetrating into the space between the electrodes, which causes electron beam misconvergence.

In copending U.S. patent application Ser. No. 201,692, filed Oct. 29, 1980 by R. H. Hughes and B. G. Marks, now U.S. Pat. No. 4,370,592, an electron gun is described wherein the main focus lens is formed by two spaced electrodes. Each electrode includes a plurality of apertures therein equal to the number of electron beams and also a peripheral rim, with the peripheral rims of the two electrodes facing each other. The apertured portion of each electrode is located within a recess set back from the rim. The effect of this main focus lens is to provide the gentle voltage gradient sought to reduce spherical aberration. Because of the elongated shape of the recesses and peripheral rims of the spaced electrode, there is a difference in the voltages that are required to optimize the vertical focus and the horizontal focus in both center and side guns. It is desirable to minimize this focus voltage difference so that vertical and horizontal focus are nearly optimized in all guns. The present invention provides means for accomplishing this reduction in focus voltage difference.

SUMMARY OF THE INVENTION

An improved color picture tube has an inline electron gun for generating and directing three electron beams, a center beam and two side beams, along coplanar paths toward a screen of the tube. The gun includes a main focus lens for focusing the electron beams. The main focus lens is formed by two spaced electrode members each having three separate inline apertures therein. Each electrode also includes a peripheral rim. The peripheral rims of the two electrodes face each other. The apertured portion of each electrode is within a recess set back from the rim. The width of the recess in at least one of the electrodes is narrower at the side beam paths than at the center beam path, measured perpendicular to the plane containing the electron beam paths.

BRIEF DESCRIPTION OF THE DRAWINGS

FIG. 1 is a plan view, partly in axial section, of a shadow mask color picture tube embodying the invention.

FIG. 2 is a partial axial section view of the electron gun shown in dashed lines in FIG. 1.

DETAILED DESCRIPTION OF THE PREFERRED EMBODIMENT

Figure 3:
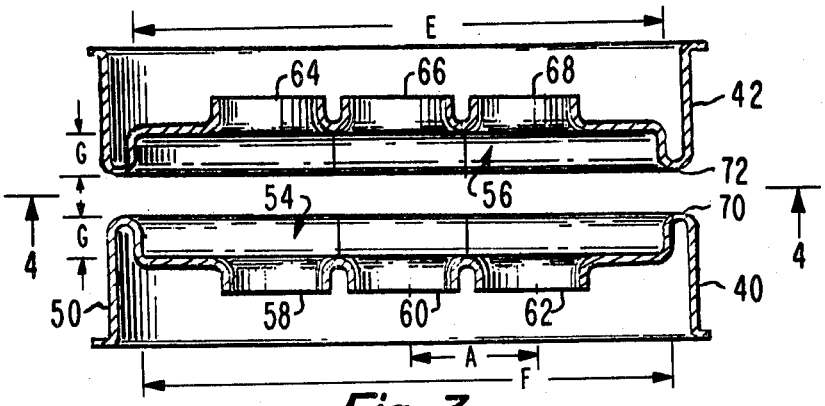
FIG. 3 is a axial sectional view of the G3 and G4 electrodes of the electron gun of FIG. 2.

FIG. 1 is a plan view of a rectangular color picture tube having a glass envelope 10 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen is preferably a line screen with the phosphor lines extending substantially perpendicular to the high frequency raster line scan of the tube (normal to the plane of FIG. 1). A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 schematically shown surrounding the neck 14 and funnel 12 in the neighborhood of their junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

The details of the gun 26 are shown in FIGS. 2 through 5. The gun comprises two glass support rods 32 on which the various electrodes are mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 also is cup-shaped, but has its open end closed with an apertured plate 52.

The facing closed ends of the G3 electrode 40 and the G4 electrode 42 have large recesses 54 and 56, respectively, therein. The recesses 54 and 56 set back the portion of the closed end of the G3 electrode 40 that contains three apertures, 58, 60 and 62, from the portion of the closed end of the G4 electrode 42 that contains three apertures, 64, 66 and 68. The remaining portions of the closed ends of the G3 electrode 40 and the G4 electrode 42 form rims 70 and 72, respectively, that extend peripherally around the recesses 54 and 56. The rims 70 and 72 are the closest portions of the two electrodes 40 and 42.

Figure 4:
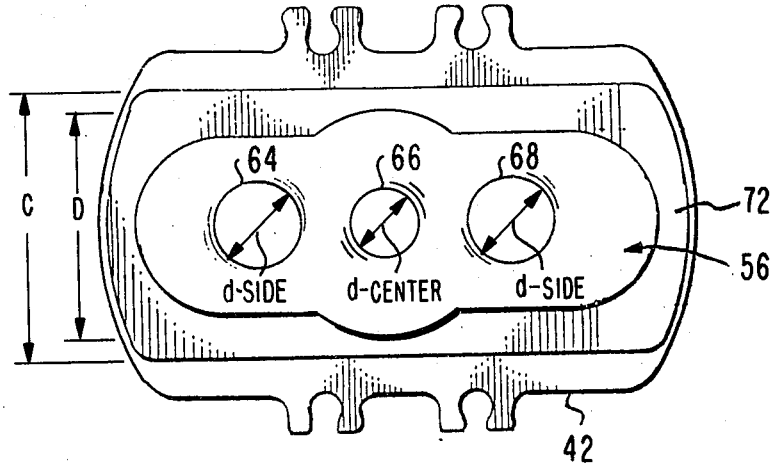
FIG. 4 is a front view of the G4 electrode taken at line 4—4 of FIG. 3.
Figure 5:
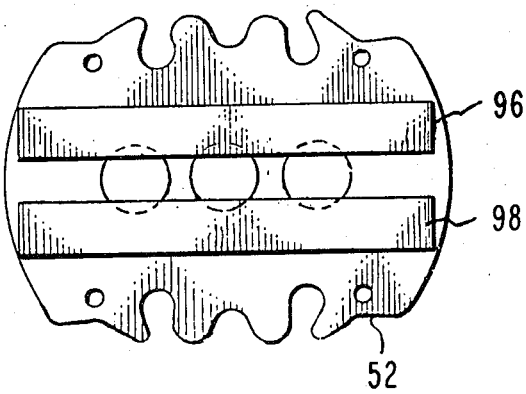
FIG. 5 is a plan view of the stigmators on the G4 electrode taken at line 5—5 of FIG. 2.

In order to minimize the vertical and horizontal focus voltage difference, the internal width dimension of the peripheral rims 70 and 72 is wider at the center beam path than it is at either of the side beam paths, the width being measured perpendicular to the plane containing the coplanar electron beam paths. Correspondingly, the recesses 54 and 56 are also wider at the center beam path than at the side beam paths. In addition to making the recesses wider at the center beam path, it also is desirable to reduce the size of the center apertures 60 and 66 in order to equalize the focus voltages required to properly focus the three electron beams. Preferably, the variation in aperture size should follow the approximate equation:

$$C/D \approx d\ side/d\ center$$

where:

C = width of recesses 54 and 56 at the center beam path (see FIG. 4)

D = width of recesses 54 and 56 at the side beam paths (see FIG. 4)

d side = diameter of side beam apertures 58, 62, 64 and 68 (see FIG. 4)

d center = diameter of center beam apertures 60 and 66 (see FIG. 4)

In effect, the smaller center beam apertures balance the larger recess at the center beam path to achieve an equal or nearly equal focus voltage as required by the side electron beams.

The electron gun 26 of FIG. 2 provides a main focusing lens having substantially reduced spherical aberration compared to that of prior guns discussed above. The reduction in spherical aberration is caused by an increase in the size of the main focus lens. This increase in lens size results from recessing the electrode apertures. In most prior inline guns, the strongest equipotential lines of the electrostatic field are concentrated at each opposing pair of apertures. However, in the gun 26 of FIG. 2, the strongest equipotential lines extend continuously from between the rims 70 and 72, so that the predominant portion of the main focus lens appears to be a single large lens extending through the three electron beam paths. The remaining portion of the main focus lens is formed by weaker equipotential lines located at the apertures in the electrodes. The performance and advantages of an electron gun similar to the electron gun 26 are discussed in previously-cited copending U.S. patent application Ser. No. 201,692.

There is a slot effect astigmatism formed by the main focusing lens as a result of penetration of the focusing field through the asymmetrical open areas of the recesses. The field penetration causes the focus lens to have greater vertical lens strength than horizontal lens strength. A correction is made for this astigmatism in the electron gun 26 of FIG. 2 by the inclusion of a horizontal slot opening at the exit of the G4 electrode 42. The slot is preferably spaced at 86 percent of the lens diameter from the opposite surface of the G4 electrode. This slot is formed by two strips 96 and 98, shown in FIGS. 2 and 5, welded to the apertured plate 52 of the G4 electrode 42 so as to extend across the three apertures therein in the plate 52.

To statically converge the two outer beams with the center beam, the length "E" of the recess 56 in the G4 electrode 42 is slightly greater than the length "F" of the recess 54 in the G3 electrode 40 (FIG. 3). The effect of the greater recess length in the G4 electrode 42 is the same as that discussed with respect to the offset apertures in U.S. Pat. No. 3,772,554, issued to Hughes on Nov. 13, 1973.

Some typical dimensions for the electron gun 26 of FIG. 2 are presented in the following table.

TABLE

| | |
|---|---|
| External diameter of tube neck | 29.00 mm |
| Internal diameter of tube neck | 24.00 mm |
| Spacing between G3 and G4 electrodes 40 and 42 | 1.27 mm |
| Center-to-center spacing between adjacent apertures in G3 electrode 40 (A in FIG. 3) | 5.0 mm |
| Inner diameter of apertures 58, 62, 64 and 68 (d side in FIG. 4) | 4.0 mm |
| Inner diameter of apertures 60 and 66 (d center in FIG. 4) | 3.59 mm |
| Width at center beam path of recess 56 in G4 electrode 42 (C in FIG. 4) | 7.02 mm |
| Width near outer beam paths of recess 56 in G4 electrode 42 (D in FIG. 4) | 6.30 mm |
| Length of recess 56 in G4 electrode 42 (E in FIG. 3) | 20.8 mm |
| Length of recess 54 in G3 electrode 40 (F in FIG. 3) | 20.2 mm |
| Depth of recesses in the electrodes 40 and 42 (G in FIG. 3) | 1.65 mm |

In various other inline electron gun embodiments, the depth "G" of the recesses in the electrodes 40 and 42 may vary from 1.30 mm to 2.80 mm and in other embodiments the depth of the recesses in the electrodes 40 and 42 may vary from each other.

What is claimed is:

1. In a color picture tube having an inline electron gun for generating and directing three electron beams, a center beam and two side beams, along coplanar paths toward a screen of said tube, said gun including a main focus lens for focusing said electron beams, the main focus lens being formed by two spaced electrode members each having three separate inline apertures therein, each electrode also including a peripheral rim, the peripheral rims of the two electrodes facing each other, and the apertured portion of each electrode being within a recess set back from the rim, the improvement comprising the width of the recess in at least one of the electrodes being wider at the center beam path than at the side beam paths, measured perpendicular to the plane containing the electron beam paths.

2. The tube as defined in claim 1, including the center aperture of the three separate inline apertures in said at least one electrode having a smaller diameter than the side apertures.

3. The tube as defined in claim 2, wherein in said at least one electrode the ratio of the diameter of the center aperture to the diameter of the side apertures approximately equals the ratio of the width of the recess at the side beam paths to the width of the recess at the center beam path.

* * * * *